US007100624B2

(12) United States Patent
Lee

(10) Patent No.: US 7,100,624 B2
(45) Date of Patent: Sep. 5, 2006

(54) UMBRELLA WITH LAMPS MOUNTED DETACHABLY WITHIN HOLES IN COVER SUPPORT RIBS

(76) Inventor: Henry Lee, 7F-1, No. 303, Sec. 3, Chung-Hsiao E. Rd., Taipei City (TW)

( * ) Notice: Subject to any disclaimer, the term of this patent is extended or adjusted under 35 U.S.C. 154(b) by 267 days.

(21) Appl. No.: 10/762,020

(22) Filed: Jan. 21, 2004

(65) Prior Publication Data

US 2005/0155636 A1 Jul. 21, 2005

(51) Int. Cl.
*A45B 3/04* (2006.01)

(52) U.S. Cl. ..... 135/16; 135/98; 135/910; 362/102; 362/249

(58) Field of Classification Search ..... 135/16, 135/98, 910; 362/102, 249, 234, 252; 248/214, 248/314
See application file for complete search history.

(56) References Cited

U.S. PATENT DOCUMENTS 3,189,310 A * 6/1965 Trueson ..... 248/314
5,555,163 A * 9/1996 Pisani ..... 362/252
6,217,192 B1 * 4/2001 Stratton ..... 362/249
6,302,560 B1 * 10/2001 Lai ..... 362/249
6,439,249 B1 * 8/2002 Pan et al. ..... 135/16
6,499,856 B1 * 12/2002 Lee ..... 362/102
6,612,713 B1 * 9/2003 Kuelbs ..... 362/102
6,666,224 B1 * 12/2003 Lee ..... 135/16
6,692,135 B1 * 2/2004 Li ..... 362/102
6,773,140 B1 * 8/2004 Lee ..... 362/249
6,923,194 B1 * 8/2005 Li ..... 135/21
6,966,667 B1 * 11/2005 Li ..... 362/102
2003/0084931 A1 5/2003 Lee
2004/0184261 A1 * 9/2004 Lin ..... 362/102

* cited by examiner

*Primary Examiner*—Winnie Yip
(74) *Attorney, Agent, or Firm*—Christensen O'Connor Johnson Kindness PLLC

(57) ABSTRACT

An umbrella includes a pole with an axially extending wire hole, a cover, and a plurality of cover support ribs, each of which is formed with a plurality of lamp holes, within each of which a lamp is mounted detachably. A main wire member extends through the wire hole in the pole. A plurality of branch wire members connect the lamps respectively and electrically to the main wire member. Each of the branch wire members is disposed between the cover and a corresponding one of the cover support ribs.

3 Claims, 5 Drawing Sheets

UMBRELLA WITH LAMPS MOUNTED DETACHABLY WITHIN HOLES IN COVER SUPPORT RIBS

BACKGROUND OF THE INVENTION

1. Field of the Invention

This invention relates to an umbrella, and more particularly to an umbrella that includes a plurality of lamps mounted respectively and detachably within a plurality of holes in cover support ribs.

2. Description of the Related Art

Sometimes, a plurality of lamps are mounted detachably on a conventional garden umbrella for purpose of decoration or illumination. However, the lamps are exposed outwardly of the pole and ribs of the conventional garden umbrella, and are likely to be damaged. Furthermore, it is difficult to open and close the conventional garden umbrella due to the presence of the lamps.

SUMMARY OF THE INVENTION

The object of this invention is to provide an umbrella that includes a plurality of lamps mounted respectively and detachably within holes in cover support ribs of the umbrella so that they will not be damaged easily and so that the umbrella can be opened and closed easily.

According to this invention, an umbrella includes a pole with an axially extending wire hole, a cover, and a plurality of cover support ribs, each of which is formed with a plurality of lamp holes, within each of which a lamp is mounted detachably. A main wire member extends through the wire hole in the pole. A plurality of branch wire members connect the lamps respectively and electrically to the main wire member. Each of the branch wire members is disposed between the cover and a corresponding one of the cover support ribs.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
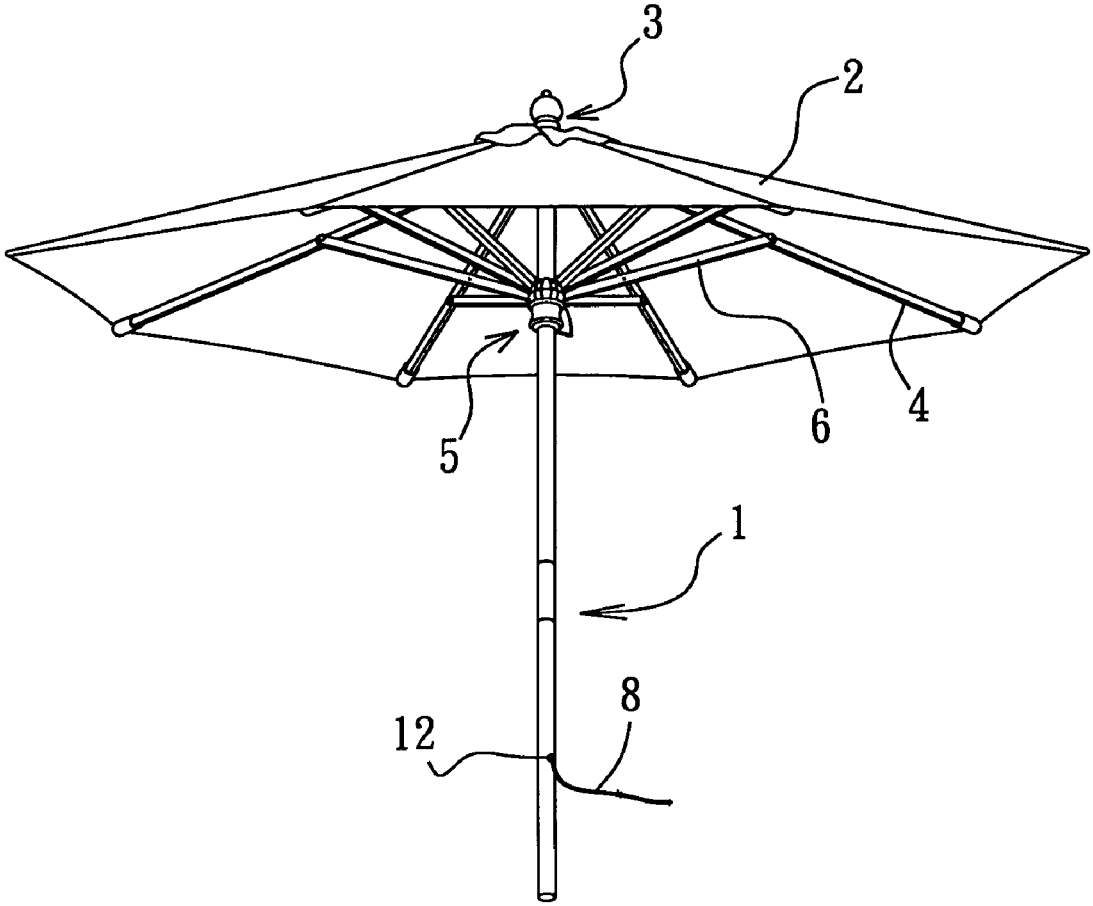
FIG. 1 is a perspective view of the first preferred embodiment of an umbrella according to this invention.
Figure 2:
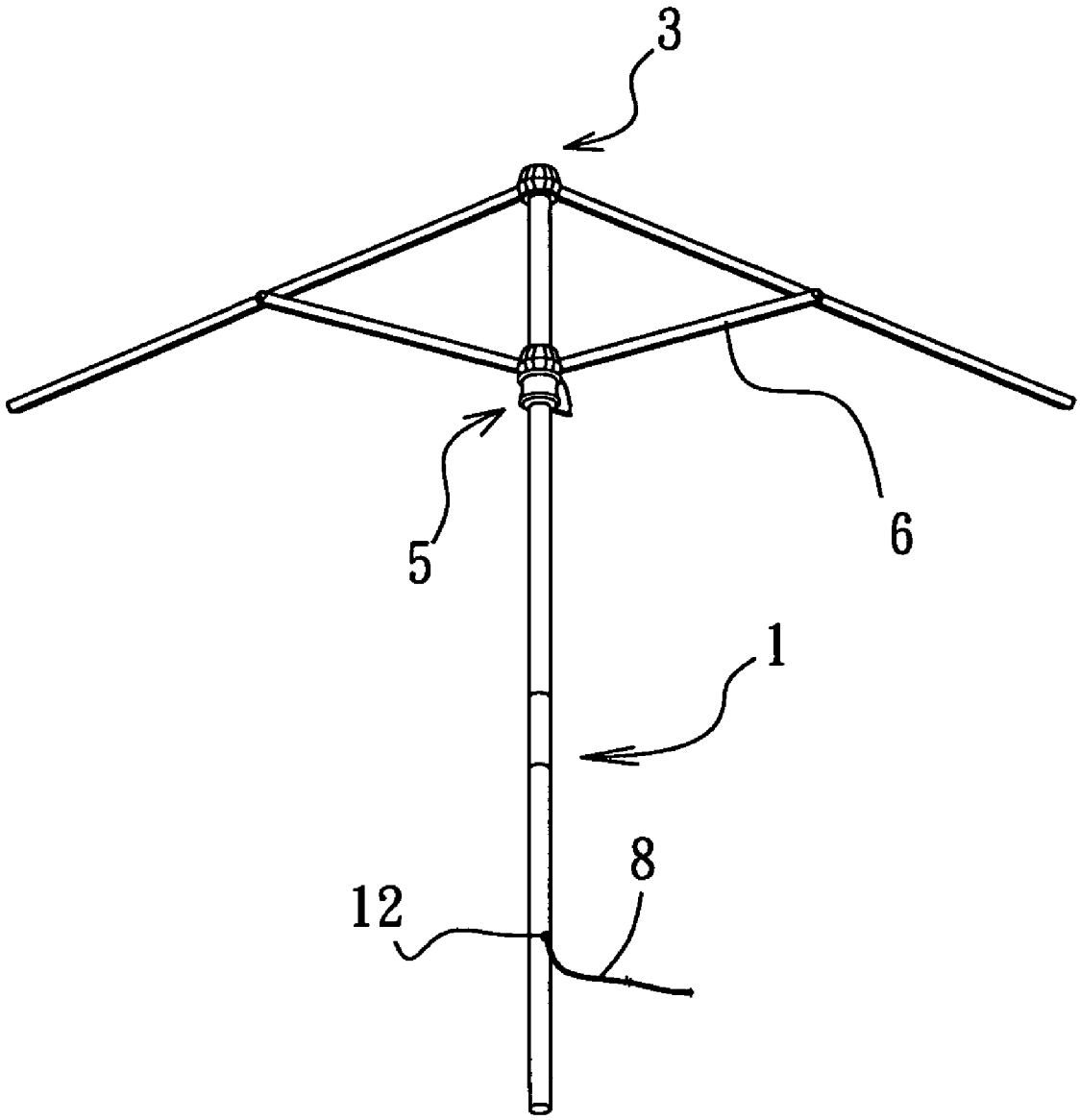
FIG. 2 is a schematic side view of the first preferred embodiment.

Referring to FIGS. 1 and 2, the preferred embodiment of an umbrella according to this invention is shown to include an upright pole 1, a cover 2, a hub 3, a plurality of cover support ribs 4, a runner 5, a plurality of stretcher ribs 6, a plurality of lamps 7 (see FIGS. 5 and 6), a main wire member 8, and a plurality of branch wire members 9.

Figure 3:
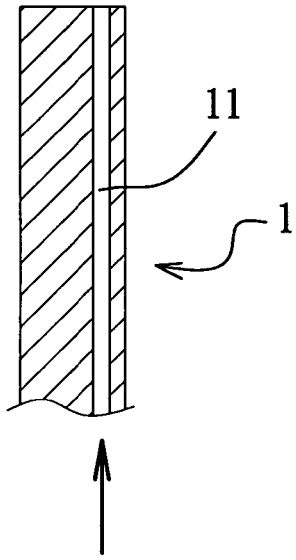
FIG. 3 is a fragmentary sectional view of a pole of the first preferred embodiment.

The pole 1 is formed with an axially extending wire hole 11 (see FIG. 3) having an open upper end formed in an upper end surface of the pole 1, and a wire inlet 12 formed in a lower portion of the pole 1 and communicated with a lower end of the wire hole 11. The hub 3 is coupled to an upper end of the pole 1.

Referring to FIGS. 1, 2, 4, 5, and 6, each of the cover support ribs 4 has an inner end connected pivotally to the pole 1 in a known manner, a top surface 41 fastened to and supporting the cover 2 thereon, a bottom surface 42 opposite to the top surface 41, and a lamp hole 43 having an upper end that is formed in the top surface 41, and a lower end that is formed in the bottom surface 42.

The runner 5 is sleeved movably on the pole 1 in a known manner.

The stretcher ribs 6 have inner ends connected pivotally to the runner 5, and outer ends connected respectively and pivotally to the cover support ribs 4.

The lamps 7 are configured as bulbs or light-emitting diodes, and are mounted respectively and detachably within the lamp holes 43 in the cover support ribs 4 for purpose of decoration or illumination.

The main wire member 8 extends through the wire hole 11 and the wire inlet 12 in the pole 1.

The branch wire members 9 are connected respectively and electrically to the lamps 7, and are connected electrically to the main wire member 8, e.g. in parallel or in series. Preferably, the branch wire members 9 are connected electrically to the main wire member 8 in parallel. As such, when one of the lamps 7 malfunctions, the remaining lamps 7 can still be lit up. Each of the branch wire members 9 is disposed between the cover 2 and the corresponding cover support rib 4. When the umbrella is in a spread-out position, the cover support ribs 4 are fastened to and abut against the cover 2 so that the branch wire members 9 are clamped between the cover 2 and the cover support ribs 4.

To mount the lamps 7 detachably within the lamp holes 43 in the cover support ribs 4, a plurality of retainers 71 are mounted respectively within the lamp holes 43 in the cover support ribs 4, and are disposed respectively around the lamps 7. Each of the retainers 71 includes an annular reflector shield 72 and two barb-shaped flexible retaining arms 73.

Figure 4:
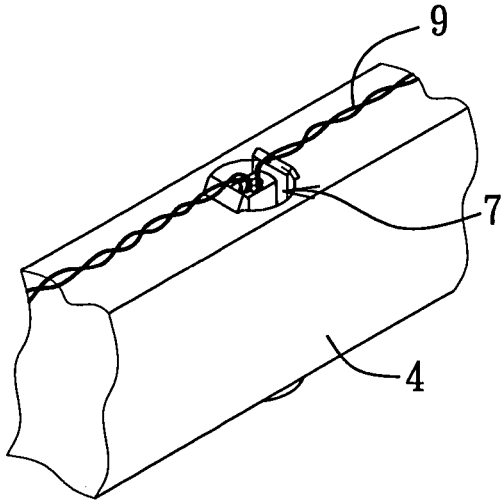
FIG. 4 is a fragmentary perspective view of a branch wire member, a retainer, and a cover support rib of the first preferred embodiment.
Figure 5:
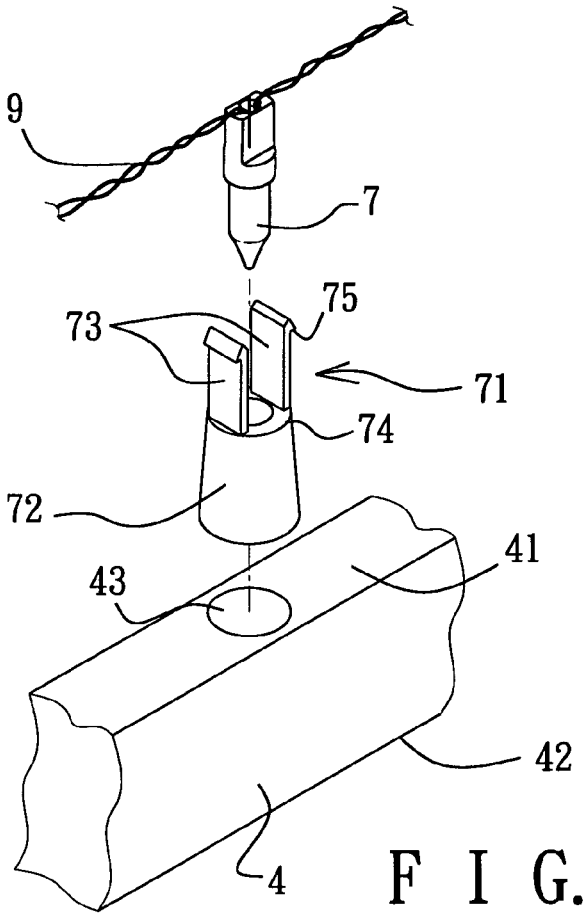
FIG. 5 is a fragmentary exploded view of the branch wire member, the retainer, and the cover support rib of the first preferred embodiment.
Figure 6:
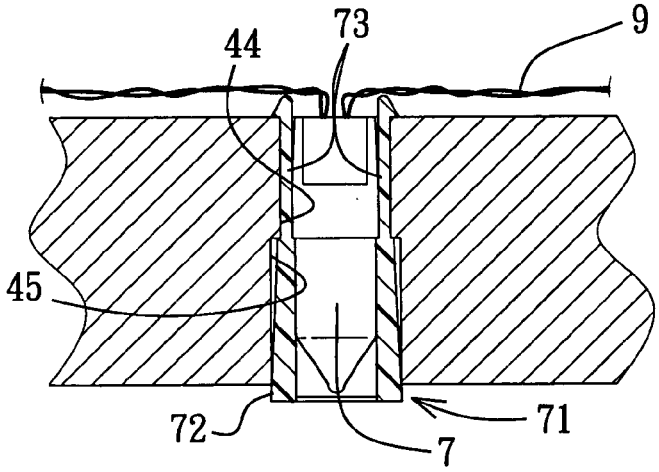
FIG. 6 is a fragmentary sectional view of the branch wire member, the retainer, and the cover support rib of the first preferred embodiment.

FIGS. 4, 5, and 6 show an assembly of one cover support rib 4, one branch wire member 9, one lamp 7, and one retainer 71, and illustrate how the lamp 7 is mounted detachably within one lamp hole 43 in the cover support rib 4 by the retainer 71. The lamp hole 43 in the cover support rib 4 has a small-diameter upper hole portion 44 and a large-diameter lower hole portion 45 that has an upper end connected to a lower end of the upper hole portion 44 and that has a diameter which is larger than that of the upper hole portion 44. The reflector shield 72 of the retainer 71 is mounted within the lower hole portion 45 of the lamp hole 43 in the cover support rib 4, is disposed around the lamp 7, is shaped as a truncated cone, and has a diameter that increases downwardly. As such, the retainer 71 is used not only as the support base for the lamp 7, but is also used to increase the brightness of light underneath the cover 2 (see FIG. 1). The bottom end of the reflector shield 72 of the retainer 71 has a diameter which is slightly larger than that of a lower end of the lamp hole 43 in the cover support rib 4 so as to prevent the bottom end of the reflector shield 72 of the retainer 71 from moving into the lamp hole 43 in the cover support rib 4. Each of the retaining arms 73 has an upright arm portion 74 formed integrally with the reflector shield 72 at a lower end thereof, and a retaining portion 75 that extends integrally and laterally from an upper end of the upright arm portion 74 and that abuts against the top surface 41 of the cover support rib 4 so as to prevent the retaining portion 75 from moving into the lamp hole 43 in the cover support rib 4. The retaining portions 75 of the retaining arms 73 of the retainer 71 extend away from each other, and can be moved forcibly toward each other so as to permit the retaining portions 75 of the retaining arms 73 of the retainer 71 to be pushed into and through the lamp hole 43 in the cover support rib 4, thereby removing the retainer 71 from the lamp hole 43 in the cover support rib 4.

Figure 7:
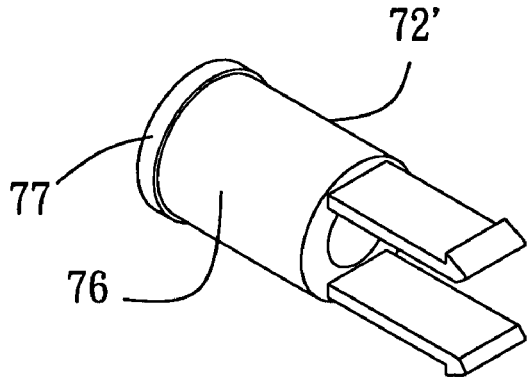
FIG. 7 is a perspective view of a retainer of the second preferred embodiment of an umbrella according to this invention.
Figure 8:
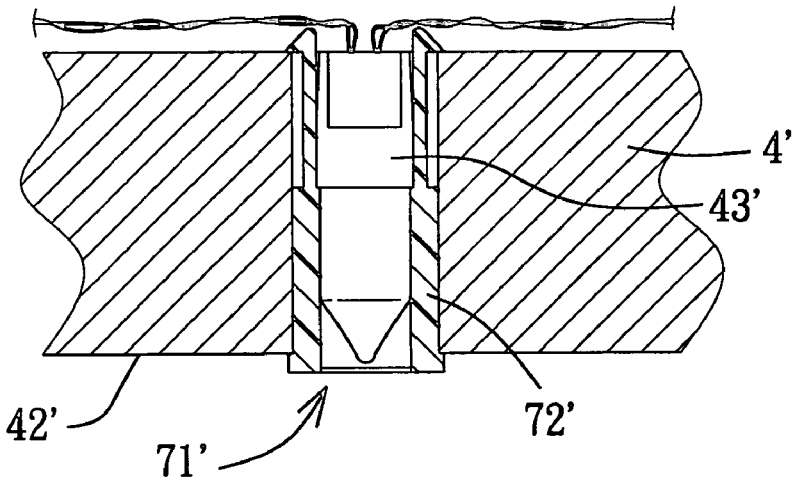
FIG. 8 is a fragmentary sectional view of the retainer and a cover support rib of the second preferred embodiment.

The shapes of the reflector shields 72 of the lamps 7 and the lamp holes 43 in the cover support ribs 4 can be modified. FIGS. 7 and 8 show a modified reflector shield 72' of a retainer 71' and a modified lamp hole 43' in a cover support rib 4'. The lamp hole 43, in the cover support rib 4' is cylindrical. The reflector shield 72' is formed with a cylindrical shield portion 76 that has open upper and lower ends and that is disposed within the lamp hole 43' in the cover support rib 4', and a flange 77 that extends integrally, radially, and outwardly from a lower end of the cylindrical shield portion 76 and that has a top surface which abuts against a bottom surface 42' of the cover support rib 4' so as to prevent the flange 77 from moving into the lamp hole 43' in the cover support rib 4'.

With this invention thus explained, it is apparent that numerous modifications and variations can be made without departing from the scope and spirit of this invention. It is therefore intended that this invention be limited only as indicated by the appended claims.

I claim:

1. An umbrella comprising:

a pole with an axially extending wire hole;

a cover;

a plurality of cover support ribs, each of which has an inner end connected pivotally to said pole, a top surface supporting said cover thereon, a bottom surface opposite to said top surface, and a lamp hole having an upper end that is formed in said top surface, and a lower end that is formed in said bottom surface;

a runner sleeved movably on said pole;

a plurality of stretcher ribs having inner ends connected pivotally to said runner, and outer ends connected respectively and pivotally to said cover support ribs;

a plurality of lamps mounted respectively and detachably within said lamp holes;

a main wire member extending through said wire hole in said pole;

a plurality of branch wire members connecting said lamps respectively and electrically to said main wire member, each of said branch wire members being disposed between said cover and a corresponding one of said cover support ribs;

a plurality of retainers disposed respectively within said lamp holes in said cover support ribs and connected respectively to said lamps so that said lamps are mounted respectively and detachably within said lamp holes in said cover support ribs, each of said retainers including:

an annular reflector shield mounted within a respective one of said lamp holes in said cover support ribs and disposed around a respective one of said lamps, said reflector shield having a bottom end which is sized so as to prevent said bottom end of said reflector shield of a corresponding one of said retainers from moving into the respective one of said lamp holes in said cover support ribs; and two barb-shaped flexible retaining arms, each of which has an upright arm portion that is formed integrally with said reflector shield at a lower end thereof, and a retaining portion that extends integrally and laterally from an upper end of said upright arm portion and that abuts against said top surface of a corresponding one of said cover support ribs so as to prevent said retaining portion from moving into a corresponding one of said lamp holes in said cover support ribs, said retaining portions of said retaining arms of each of said retainers extending away from each other and being movable forcibly toward each other so as to permit said retaining portions of said retaining arms of the corresponding one of said retainers to be pushed into and through the respective one of said lamp holes in said cover support ribs, thereby removing the corresponding one of said retainers from the respective one of said lamp holes in said cover support ribs.

2. The umbrella as claimed in claim 1, wherein said reflector shield of each of said retainers is shaped as a truncated cone, and has a diameter that increases downwardly, said bottom end of said reflector shield of each of said retainers being slightly larger than said lower end of the corresponding one of said lamp holes in said cover support ribs in diameter.

3. The umbrella as claimed in claim 1, wherein said reflector shield of each of said retainers is formed with a cylindrical shield portion that has open upper and lower ends and that is disposed within the respective one of said lamp holes in said cover support ribs, and a flange that extends integrally, radially, and outwardly from said lower end of said cylindrical shield portion and that has a top surface which abuts against said bottom surface of the corresponding one of said cover support ribs.

* * * * *